United States Patent [19]

Chung

[11] Patent Number: 4,602,789

[45] Date of Patent: Jul. 29, 1986

[54] GOLF BALL TEEING APPARATUS

[76] Inventor: Bong J. Chung, 5611 Booth Avenue, Burnaby, British Columbia, Canada, V5H 6A3

[21] Appl. No.: 492,492

[22] Filed: May 6, 1983

[51] Int. Cl.[4] ..... A63B 57/00

[52] U.S. Cl. ..... 273/201; 124/50

[58] Field of Search ..... 273/201, 26 D, 29 A; 124/50

[56] References Cited

U.S. PATENT DOCUMENTS

| | | | |
|---|---|---|---|
| 1,598,971 | 9/1926 | Kenyon | 273/201 |
| 1,850,174 | 3/1932 | Joseph | 273/201 |
| 1,888,256 | 11/1932 | Baumgarten | 273/201 |
| 2,127,282 | 8/1938 | Beckett | 273/201 |
| 2,295,599 | 9/1942 | Mozel | 273/201 |
| 4,269,162 | 5/1981 | Abraham | 273/26 D |

*Primary Examiner*—Richard C. Pinkham

*Assistant Examiner*—T. Brown

*Attorney, Agent, or Firm*—Carver & Co.

[57] ABSTRACT

A golf ball teeing apparatus has an upper surface. A tee-like device has a ball receiving top and is vertically reciprocable between a retracted position and a raised position where the top is above the upper surface. A feed mechanism feeds one ball at a time onto the top of the tee-like device. The feed mechanism is adjacent the top of the tee-like device when the tee-like device is in the retracted position. A guide track slopes downwardly towards the feed mechanism. A ball storage rack is below the upper surface and slopes downwardly towards a discharge end thereof. There is a ball elevator for raising balls from a lower position adjacent the discharge end of the storage rack to an upper position where the balls can roll down the guide track to the feed mechanism.

22 Claims, 18 Drawing Figures

GOLF BALL TEEING APPARATUS

BACKGROUND OF THE INVENTION

The invention relates to a golf ball teeing apparatus having a ball storage rack below the upper surface of the apparatus and a ball elevator for raising balls adjacent a discharge end of the storage rack.

Golf ball teeing apparatuses are designed to be employed primarily at driving ranges. These aparatuses obviate the need to stoop and place each ball on a tee. Instead, the apparatuses feed one ball at a time frm a ball storage compartment and place the ball in the appropriate position on a tee-like device. Typically the devices are operated by manual force on a button. For example, U.S. Pat. No. 2,127,282 to Beckett shows a device of this class including a button which is connected to a lever. The lever is connected to a tee-like device. There is a mechanism for feedng one ball at a time onto the tee-like device. This consists of rods connected to a lever.

Other U.S. Patents showing golf ball teeing appraratuses include U.S. Pat. Nos. 1,545,959 to Huyler; 1,598,971 to Kenyon; 1,695,006 to Brockhagen; 1,888,256 to Baumagartner; 1,952,113 to Beckett and 2,711,321 to McGraw.

One problem associated with the prior art devices is the fact that many of them have a ball storage container which extends above the top surface of the device. Normally the top surface of the device would be at ground level and such above-ground storage can interfere with the golfer's freedom of movement or swing. Ideally, the device should be almost entirely below ground level except for the tee-like device to duplicate golf course conditions as much as possible.

SUMMARY OF THE INVENTION

A golf ball teeing apparatus has an upper surface. There is tee means having a ball receiving top and being vertically reciprocable between a retracted position and a raised position where the top is above the upper surface. There is feed means for feeding one ball at a time onto the top of the tee means. The feed means is adjacent the top of the tee means when the tee means is in the retracted position. A guide track means slopes downwardly towards the feed means. A ball storage rack means below the upper surface slopes downwardly towards a discharge end thereof. There is ball elevating means for raising balls from a lower position adjacent the discharge end of the storage rack means to an upper position where the balls can roll down the guide track means to the feed means.

In a preferred form, there is a lever mechanism connected to the ball elevating means, the feed means and the tee means for coordinated movement thereof.

The ball elevating means may comprise a vertically movable portion of the guide track means. In this case, the elevating means is generally horizontal in the lower position.

The feed means may comprise a vertically reciprocable ball raising device capable of receivng one ball from the guide track means. The ball raising device has a lower ball receiving position aligned with the guide track means and a raised feeding position where the one ball is raised above the guide track means. Preferably, the ball raising device has a ball receiving top which is sloped downwardly towards the top of the tee means in the raised position.

The apparatus may further comprise a vertical tube, the tee means being vertically reciprocable in the tube. The tee means has a cross sectional extent slightly less than the cross sectional extent of the tube. There is deflection means selectively projectable into the tube to tilt the tee means as the tee means moves to the raised position so a ball moving upwardly from the tee means is discharged onto the upper surface of the apparatus.

Figure 1:
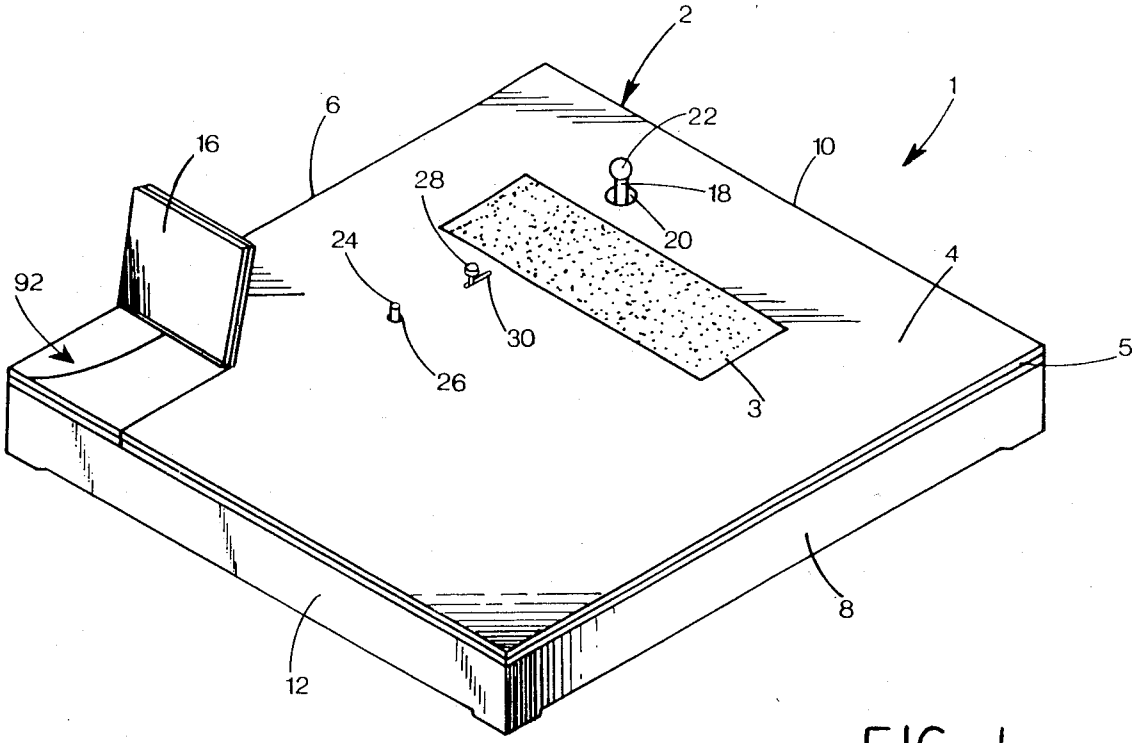
FIG. 1 is a perspective view showing the top, one end and one side of a golf ball teeing apparatus according to an embodiment of the invention.

FIG. *2a* is a top plan view, partly fragmentary, of one end of the apparatus of FIG. 1 with the upper surface removed;

FIG. *2b* is a continuation of FIG. *2a* and is a plan of the end of the apparatus opposite the one end of FIG. *2a;*

FIG. *3a* is a sectional view along line 3—3 of FIGS. *2a* and *2b* showing one end of the apparatus and the tee means in the raised position;

FIG. *3b* is a continuation of FIG. *3a* showing the end of the appratus opposite the one end of FIG. *3a;*

Figure 4:
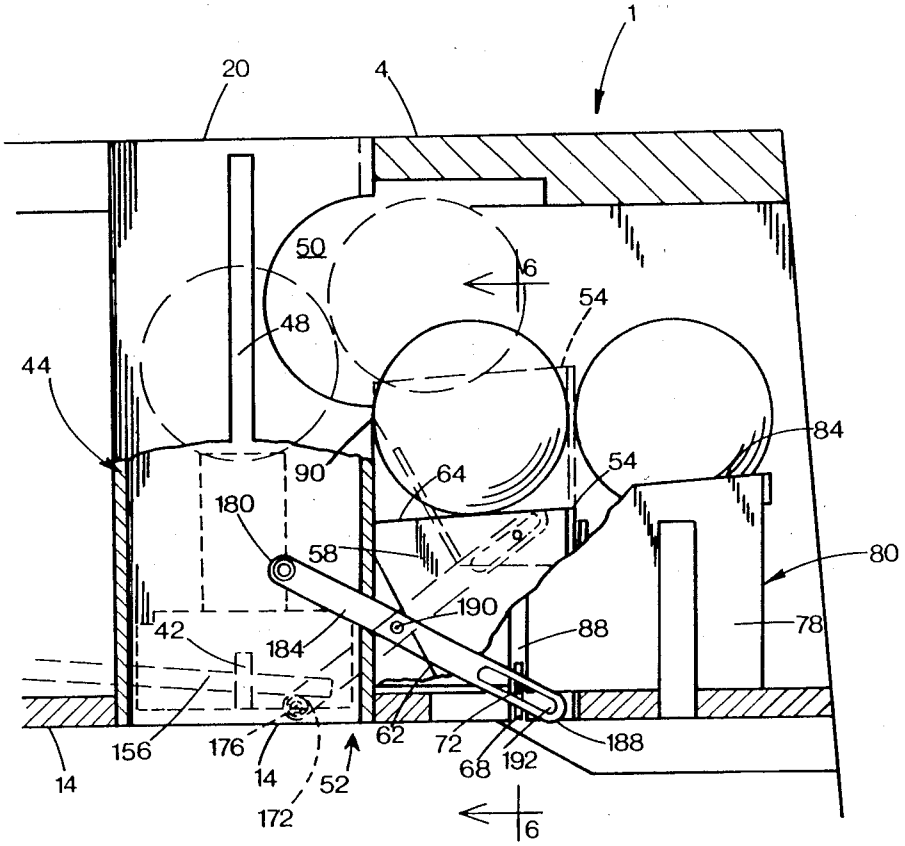
Figure 6:
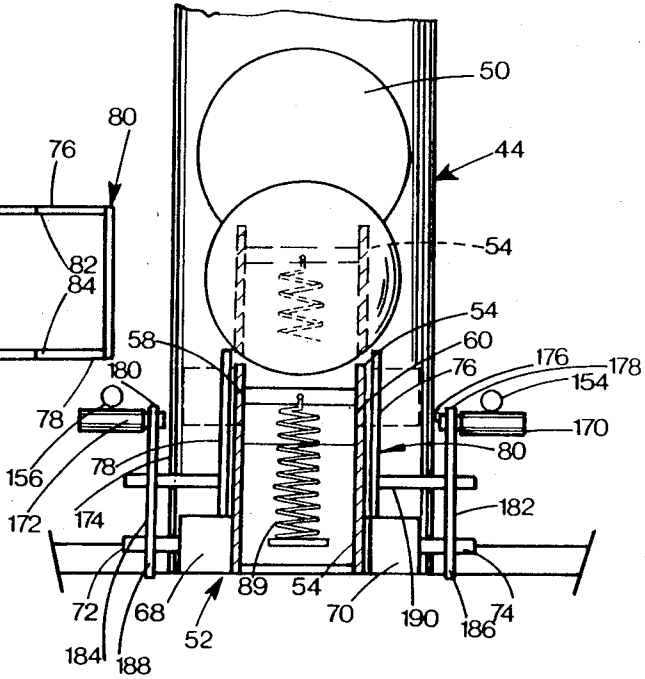
Figure 5:
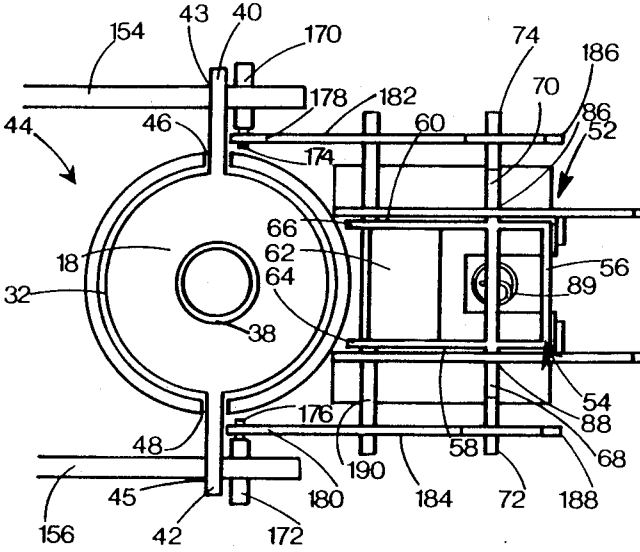
Figure 7:
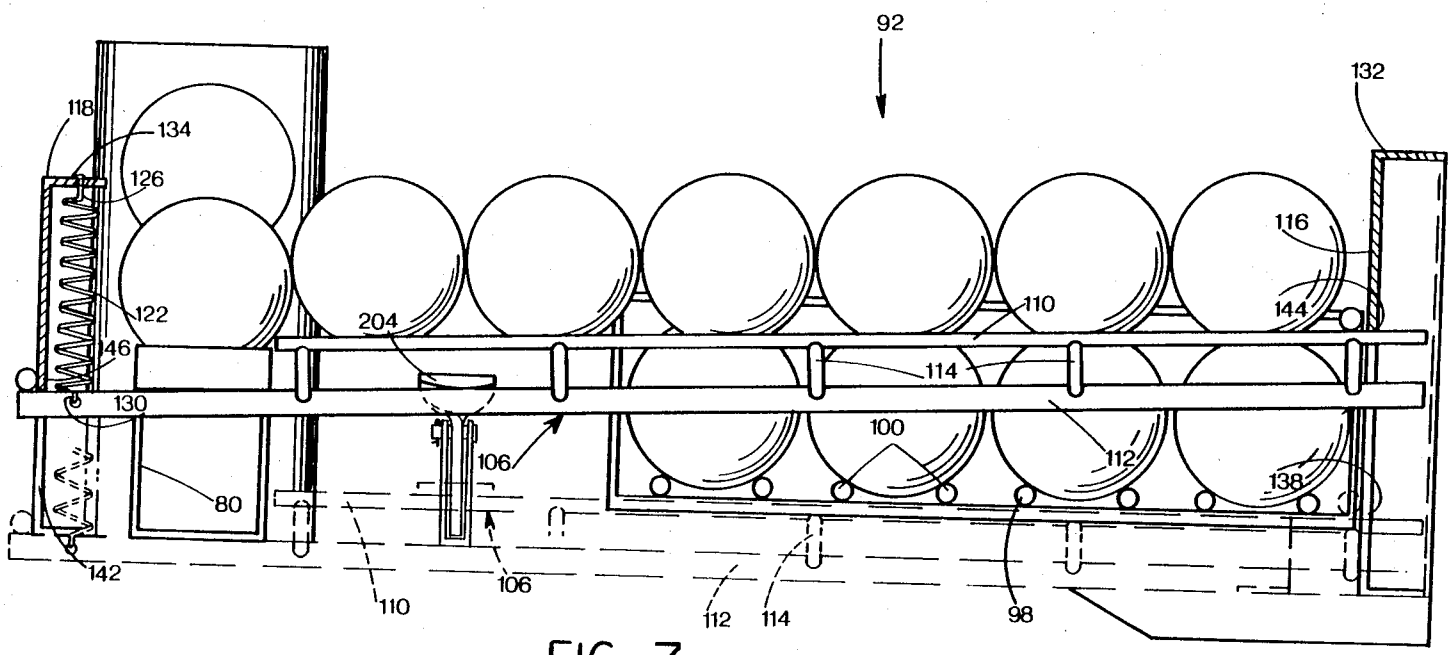

FIGS. *3c*+*3d* are views similar to FIGS. *3a* and *3b,* respectively, with the tee means in the retracted position;

FIG. 4 is a sectional view taken along line 4—4 of FIG. 2;

FIG. 5 is an enlarged top plan view showing the tee means and feed means of the apparatus;

FIG. 6 is a sectional view taken along line 6—6 of FIG. 4;

FIG. 7 is a sectional view taken along line 7—7 of FIG. *2b;*

Figure 8:
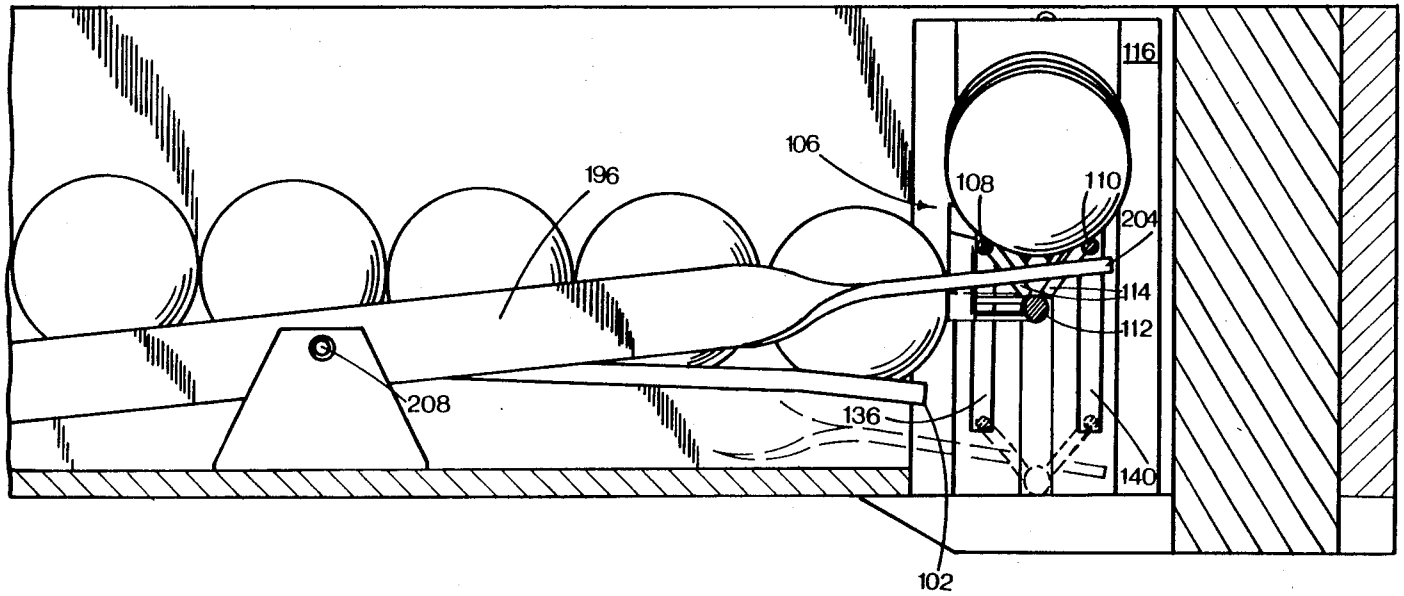

FIG. 8 is a sectional view taken along line 8—8 of FIG. *2b;*

Figure 9:
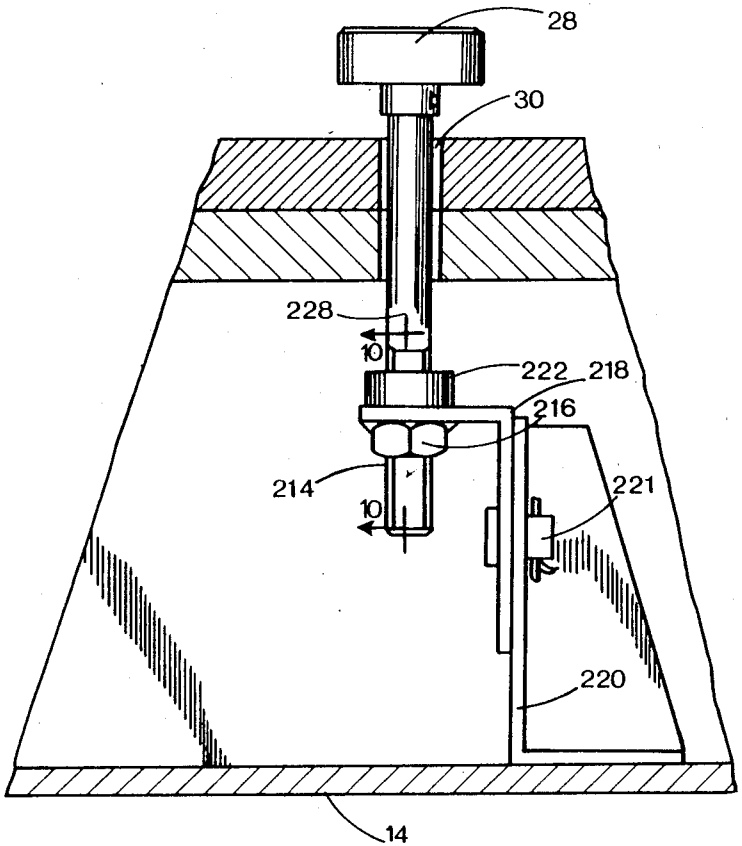

FIG. 9 is a sectional view taken along line 9—9 of FIG. *2a;*

Figure 10:
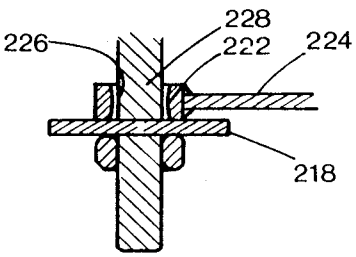
Figure 11B:
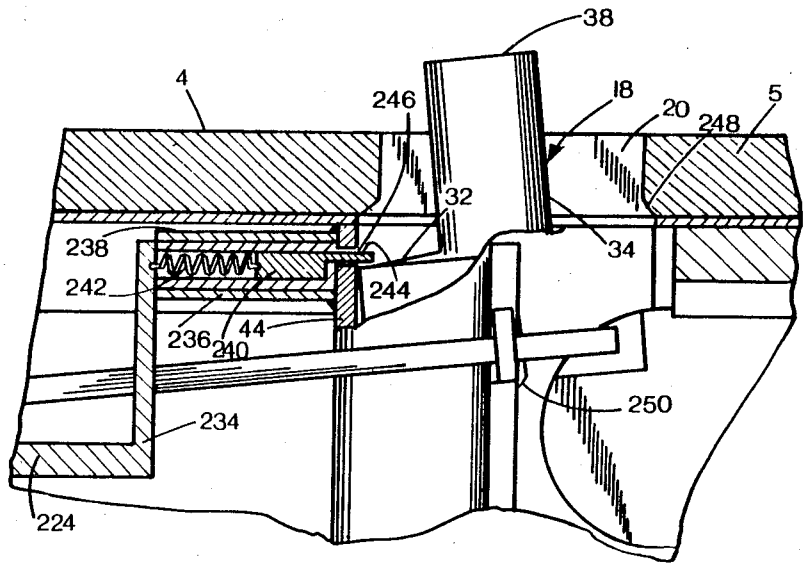
Figure 11A:
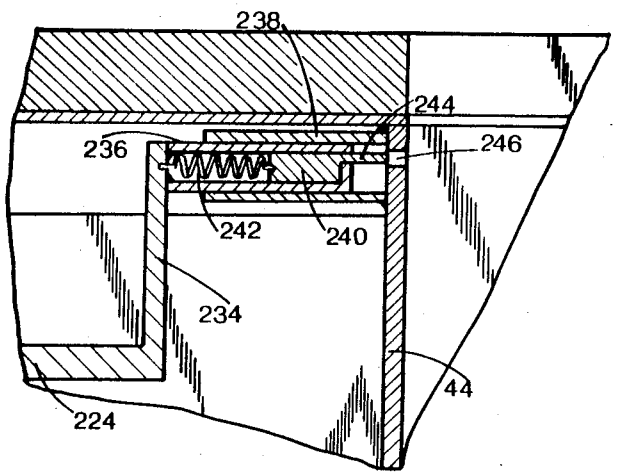
Figure 12:
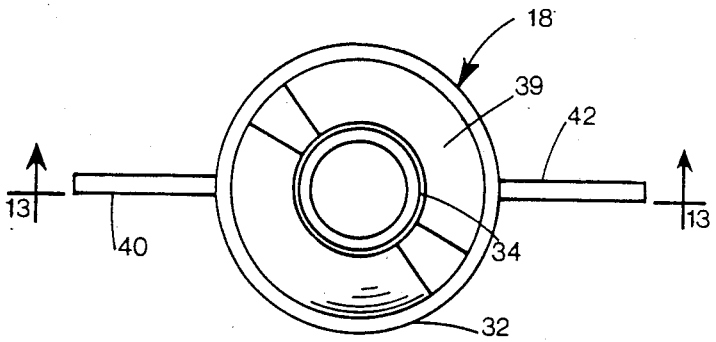

FIG. 10 is a sectional view taken along line 10—10 of FIG. 9;

FIG. 11*a* is a fragmentary sectional view taken along line 11—11 of FIG. 2 showing the tee means and the deflection means in their retracted positions;

FIG. 11*b* is a fragmentary sectional view equivalent to FIG. 11*a,* showing the tee means in the raised position, the deflection means projecting into the tube and the tee means tilted by the deflection means;

FIG. 12 is a top view of the tee means; and

Figure 13:
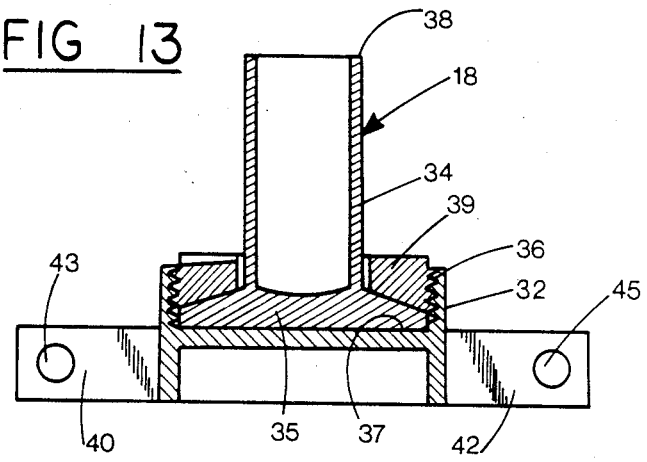

FIG. 13 is a sectional view taken along line 13—13 of FIG. 12.

DESCRIPTION OF THE PREFERRED EMBODIMENT

A golf ball teeing apparatus is shown generally at 1 in the drawings. The exterior of the apparatus is shown best in FIG. 1. The apparatus is enclosed in a casing 2 having an upper surface 4 comprising the top of a square piece of rubber mat 5, sides 6 and 8 and ends 10 and 12. Bottom 14 is shown in FIGS. *3a* and *3b*. A rectangular piece of indoor-outdoor carpet 3 is fitted within a similar sized rectangular opening in the mat 5. A hinged door 16, shown in the raised position, gives access to a ball storage compartment below upper surface 4. The apparatus has a tee-like device or tee means 18, shown in FIG. 1 in its raised position, projecting through aperture 20 in the upper surface. A ball 22 is shown positioned on the top of the tee-like device. A button 24 projects through an aperture 26 in the upper surface and serves as manually activated means for operating the apparatus. There is also a lever 28 projecting through a slot 30 on the upper surface. Lever 28 serves to move the tee-like device 18 to the position shown, or, selectively, to tilt the tee-like device at its raised position so the ball is discharged onto the carpet 3.

Figure 3A:
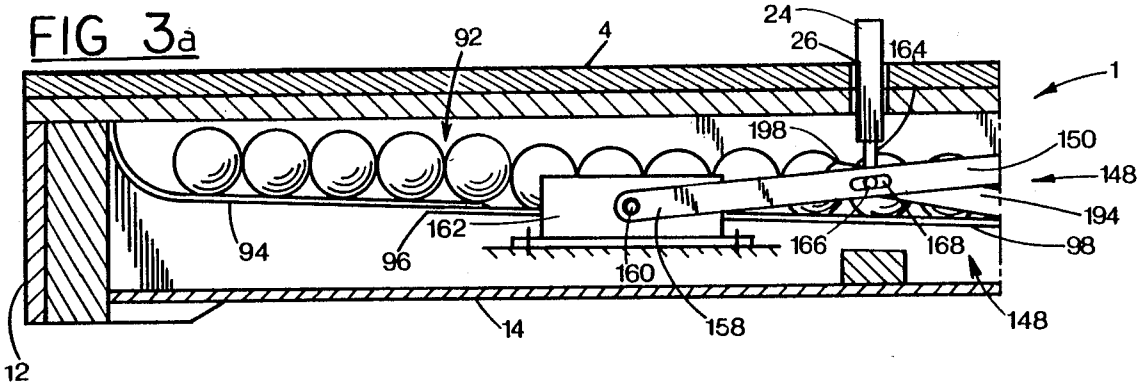
Figure 3B:
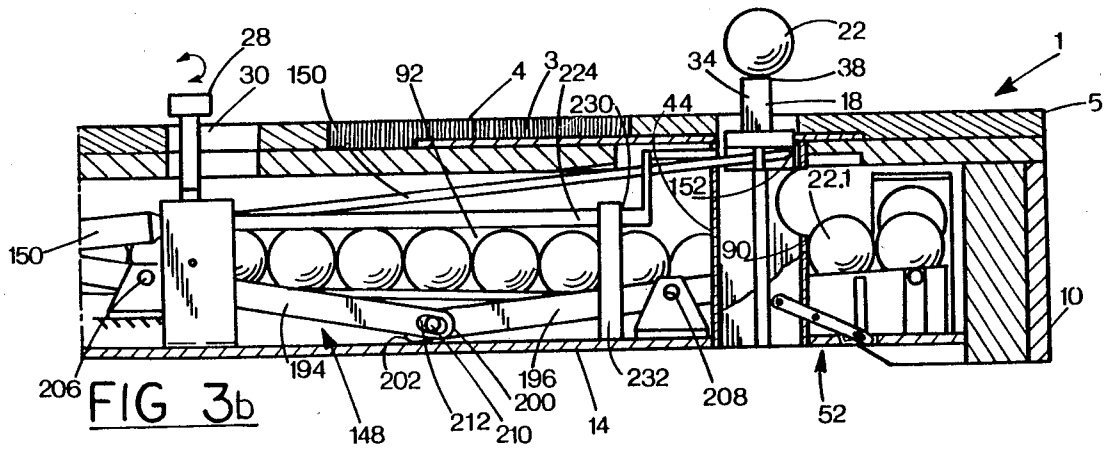

Referring to FIG. 13, the tee-like device 18 has a stem 34 connected to a disc shaped lower portion 35. The lower portion is received within a recess 37 in the top of a cylindrical base 32. A nut like male threaded member 39 is screwed onto corresponding female threads in recess 37 to hold the lower portion in place. The stem 34 has a top 38 for receiving a ball 22 as shown in FIG. 3*b*. A pair of outwardly extending flat tabs 40 and 42, perforated by apertures 43 and 45, are connected to the base as shown in FIG. 13. The tee-like device 18 is vertically reciprocable within a vertical tube 44 between a retracted position shown in FIG. 3*d* and a raised position shown in FIG. 3*b* where the top 38 is above the upper surface 4 of the apparatus.

The tube 44 is shown in better detail in FIGS. 4, and 5 and 6. The tube extends between the upper surface 4 and the bottom 14 of the apparatus and communicates with the aperture 20 as shown in FIG. 4. The tube has vertical slots 46 and 48 on each side which slidably receive tabs 40 and 42, respectively as shown in FIG. 5. Referring to FIG. 4 and 6, an aperture 50 is formed in the side of the tube near upper surface 4. The aperture 50 is circular when viewed in elevation as seen in FIG. 6 and is sized to admit a golf ball into the tube through the aperture. The inside of the tube has a diameter or cross-sectional extent slightly larger than the diameter or cross-sectional extent of the base 32 of the tee-like device. This permits the tee-like device as shown best in FIG. 5 to slide freely within the tube and to tilt slightly as shown in FIG. 11*b*.

The apparatus has a feed mechanism 52, shown best in FIGS. 4 to 6, which feeds one ball at a time onto the top 38 of the tee-like device through aperture 50 in the tube 44. The feed mechanism includes a vertically reciprocable ball raising device 54 which is rectangular when viewed from the top as shown in FIG. 5. The ball raising device has a back wall 56, side walls 58 and 60 and a front wall 62 shown in FIG. 5. The side walls 58 and 60 have tops 64 and 66 which slope downwardly in the direction of the tube 44 as seen in FIG. 4. A pair of flat tabs 68 and 70 project outwardly from side walls 58 and 60 respectively and pins 72 and 74 project outwardly from tabs 68 and 70 as shown best in FIG. 6.

Referring to FIGS. 4, 5 and 6, the ball raising device 54 is vertically reciprocable between a lower ball receiving position shown in solid lines in FIG. 4 and a raised feeding position shown in broken lines. The device is reciprocable between side walls 76 and 78 of a feeder guide track 80. The side walls of the feeder guide track have tops 82 and 84 respectively, shown in FIG. 5, which slope downwardly towards the tube 44 as best appreciated for top 84 in FIG. 4. Vertical slots 86 and 88 in the side walls of the feeder guide track, shown in FIG. 5, slidably receive tabs 70 and 68, respectively, of the ball raising device. Slot 88 is shown in better detail in FIG. 4. As may be observed in FIG. 4, the top 64 of the side wall 58 of the ball raising device slopes downwardly towards the top of the tee-like device, as does top 66 of side wall 60, when the tee-like device is in the retracted position and the ball raising device is in the raised position, both shown in broken lines. A coil spring 89 resiliently biases the ball raising device towards the raised position. The feed mechanism 52 includes a first stop for stopping a ball on the sloped top of the ball raising device when the ball raising device is in the retracted position. The first stop comprises a portion 90 of the tube 44 just below aperture 50 as shown in FIG. 4. As shown in FIG. 3*b*, this portion of the tube serves to stop a ball 22.1. The feed mechanism also includes a second stop for stopping a ball on the feeder guide track adjacent the ball raising device 54 when the ball raising device is in the raised position. The second stop comprises back wall 56 shown stopping a ball 22.2 in FIG. 3*d*.

Figure 2A:
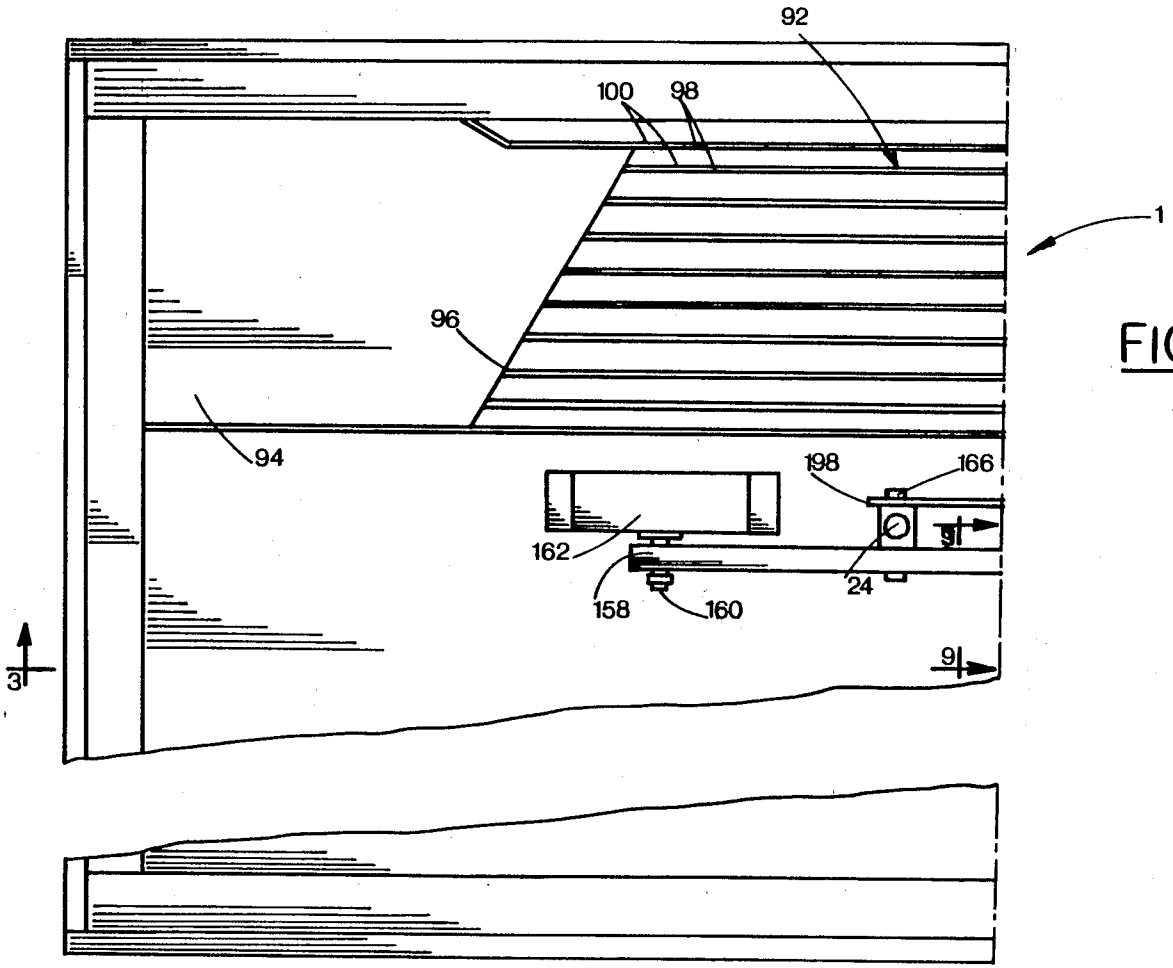
Figure 2B:
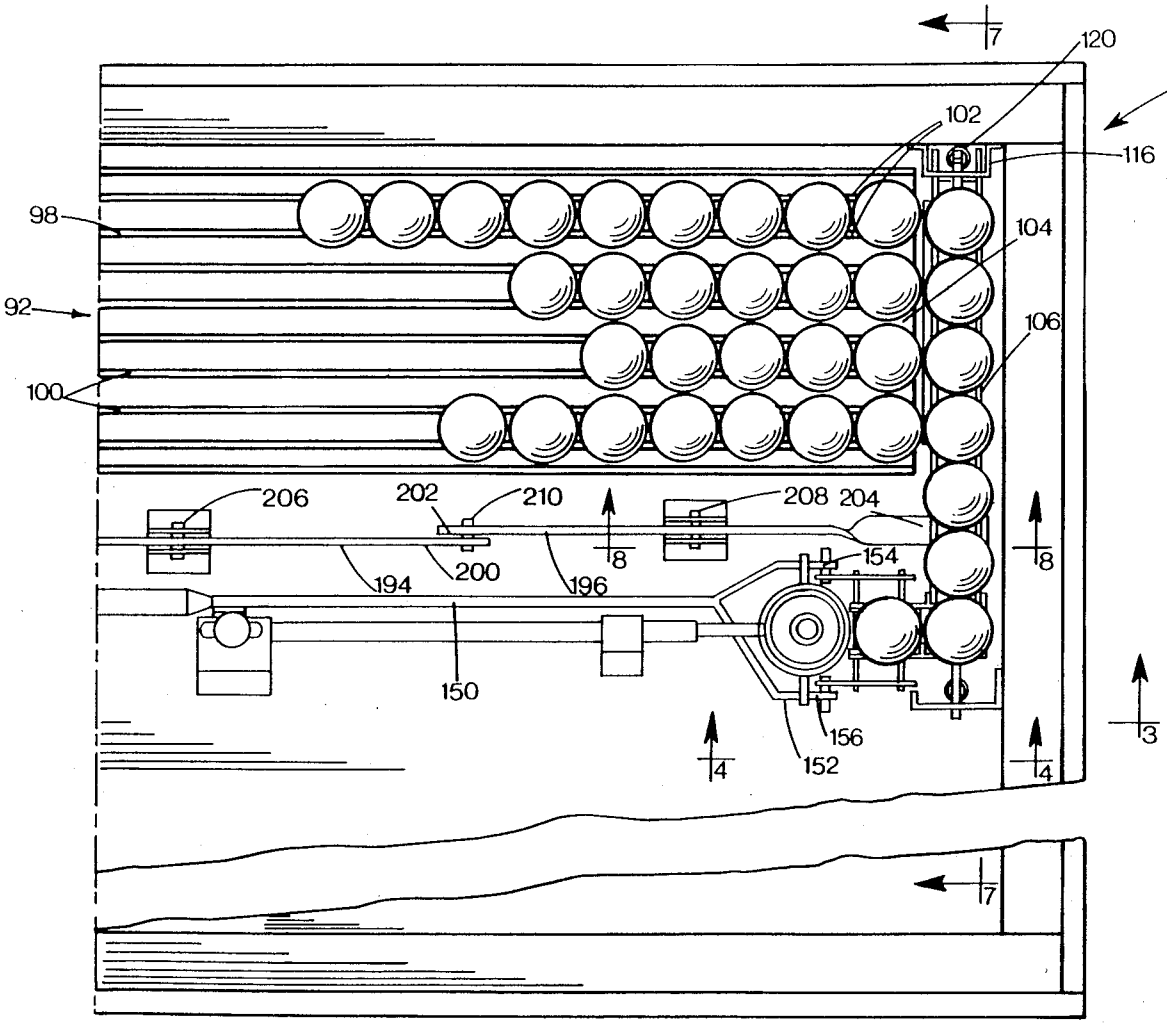
Figure 3C:
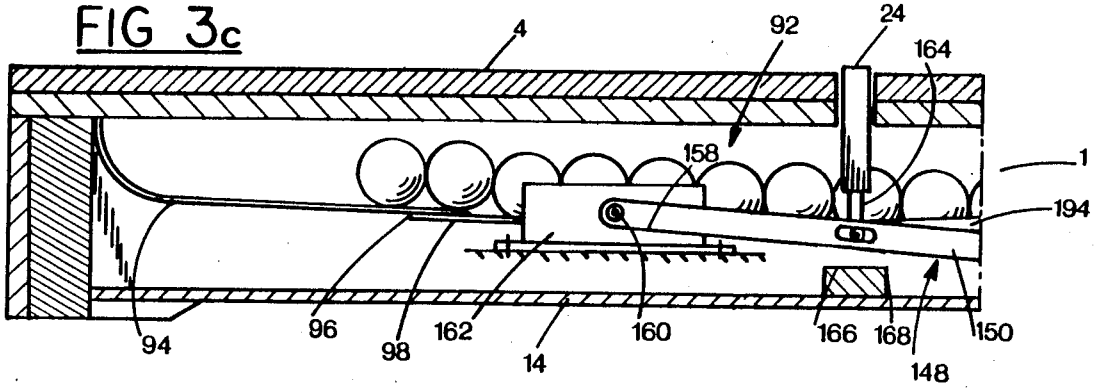

The apparatus has a ball storage compartment 92 shown in FIGS. 2*a*, 2*b*, to 3*d* and 7, which is entirely below the upper surface 4 of the apparatus. The ball storage compartment includes a sloped surface 94, shown in FIGS. 2*a*, 3*a* and 3*c* located below the door 16 shown in FIG. 1. Sloped surface 94 extends to the ball receiving end 96 of each of a plurality of storage racks 98 as shown in FIGS. 2*a*, 3*a* and 3*c*. The storage racks each consist of a pair of spaced apart rails 100 shown in FIGS. 2*a*, 2*b* and 7. The rails slope downwardly to their adjacent discharge ends 102 at the discharge end 104 of compartment 92 as shown in FIG. 2*b*.

the apparatus 1 has a ball elevator 106 shown best in FIGS. 7 and 8. The ball elevator consists of a pair of parallel top rails 108 and 110 and a bottom rail 112 which is spaced apart below the top rails and extends midway between the top rails. A plurality of struts 114 connect the bottom rail to the top rails 108 and 110. Referring to FIG. 7, there is a spring housing 116 at one end of the ball elevator and a similar, but shorter, spring housing 118 at the opposite end adjacent the feeder guide track 80. A coil spring 120 is located inside housing 116 and has a top end 124 connected to the top 132 of the housing. Spring 122 has a top end 126 connected to top 134 of housing 118. Coil spring 120 has a bottom end 128 connected to one end of bottom rail 112, while spring 122 has a bottom end 130 connected to the opposite end of the bottom rail. Top rails 108 and 110 are vertically slidable within vertical slots 136 and 140 in the housing 116 as shown in FIG. 8. Rail 112 is vertically slidable in a vertical slot 138. The opposite end of rail 112 is vertically slidable in slot 142 of housing 118. As shown in FIG. 7, rail 112 extends completely to housing 118 shown in FIG. 7, but top rails 108 and 110 extend from housing 116 to just short of feed guide track 80. Springs 120 and 122 serve as resilient means biasing the ball elevator 106 towards the upper position shown in solid lines in FIG. 7. Slots 136, 138 and 140 extend a vertically greater distance from bottom 14 on housing 116 than does slot 142 on housing 118. Portions 144 of housing 116 above the slots and the corresponding portion 146 of housing 118 therefore serve as stops for sloping the ball elevator towards the feed guide track in the upper position of the elevator as illustrated in solid lines in FIG. 7. In the lower position, shown in broken lines, the ball elevator is horizontal and adjacent the discharge end 102 of the storage racks 98 as seen in FIG. 8.

Figure 3D:
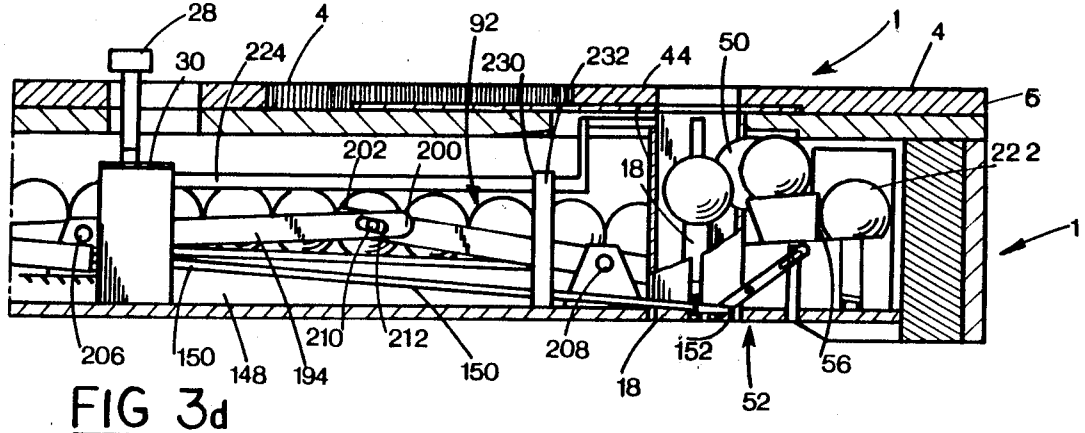

The ball elevator 106 of FIG. 7 and the ball raising device 54 of FIG. 4 are operatively connected to the tee-like device 18 by a lever mechanism 148 for coordinated movement of these components as shown generally in FIGS. 3*a*, 3*c* and 3*d*. The lever mechanism includes a first lever 150 having a bifurcated first end 152, shown in FIGS. 2*b*, 3*b* and 3*d* with two prongs 154 and 156 also shown in FIG. 5. The first lever has a second end 158 connected to the shaft 160 of a resiliently biased damping device 162 as shown in FIGS. 3*a* and 3*c*. Lever 150 is capable of pivotal movement about shaft 160 and is upwardly biased to the raised position of FIGS. 3*a* and 3*b* by the damping device. The damping device is suitably of the type used for closing doors. It serves to resiliently bias lever 150 upwards, while controlling its rate of movement. As seen in FIGS. 3*a* and 3*c*, button 24 is vertically elongated and has a bottom depending stem 164. Stem 164 is connected to first lever 150 by a pin 166 extending through slot 168 in the lever. The prongs 154 and 156 extend through apertures 43 and 45 in tabs 40 and 42 of the tee-like device 18 as shown in FIG. 5. Prong 56 is shown in detail in FIG. 11*b*. This serves to operatively connect the first lever to the tee-like device as seen in FIGS. 4 and 5. In addition, as also seen in FIGS. 5 and 6, prongs 154 and 156 bear upon rollers 170 and 172 which are rotatably mounted on pins 174 and 176. Pins 174 and 176 are connected to the first ends 178 and 180 of a pair of feed levers 182 and 184. The feed levers have second ends 186 and 188 and are pivotable about a shaft 190, shown in FIGS. 4, 5 and 6, which is connected to the feed levers between the first and second ends and mounted on the side walls 76 and 78 of the feeder guide track 80. Pin 72 of the ball raising device extends through a slot 192 near second end 188 of feed lever 184 as shown in FIG. 4. Pin 74 extends through an identical slot near the second end 186 of the feed lever 182.

Referring to FIGS. 3*a* to 3*d*, the apparatus has a second lever 194 and a third lever 196 shown in FIGS. 7 and 8. Lever 194 has a first end 198, shown in FIG. 3*a*, and a second end 200 shown in FIGS. 3*b* and 3*d*. Lever 196 has a first end 202, shown in FIG. 3*b*, and a second end 204 shown in FIGS. 7 and 8. The second lever 194 is pivotable about a pin 206 between the first end and the second end as shown in FIGS. 3*b* and 3*d*. The third lever is pivotable about a pin 208 between its first end and second end as shown in FIGS. 3*b*, 3*d* and 8.

The second lever is connected to button 24 and the first lever 150 by means of the pin 166 shown in FIGS. 3*a* and 3*b*. The pin extends through a slot in the second lever similar to the slot 168 in the first lever. A pin 210 connects the second lever and third lever near the second end of the first lever and the first end of the second lever as shown in FIGS. 3*b* and 3*d*. The pin extends through a slot 212 in the second lever and a similar slot in the third lever. The second end 204 of the third lever is horizontally flat and extends between the top rails 108 and 110 and the bottom rail 112 of the ball elevator 106 as shown in FIG. 8.

Referring to FIG. 9, lever 28 has a threaded lower portion 214 connected by a nut 216 to a first right angle bracket 218. Bracket 218 is pivotally connected to a second right angled bracket 220 by a link pin 221. Bracket 220 is mounted on the bottom 14 of the apparatus. The lever extends through a bushing 222 connected to the end of a control rod 224 shown in FIG. 10. Bushing 222 is mounted on top of bracket 218. As may be seen in FIG. 10, the interior aperture of bushing 222 has inside walls 226 which are convexly curved. In addition, the interior aperture is larger in diameter than shaft 228 of lever 28. The control rod extends slidably through aperture 230 in support column 232 shown in FIG. 3*b* and 3*d*. A step up in control rod 224 is formed by a short vertical portion 234 shown in FIGS. 11*a* and 11*b*. A short, horizontal portion 236 extends from vertical portion 234 slidably through a bushing 238. Horizontal portion 236 is hollow, having a deflector 240 slidably received therein. The deflector 240 is biased outwardly by a coil spring 242 so a tip 244 of the deflector extends through an aperture 245 in the horizontal portion shown in FIG. 11*a*. FIG. 11*a* shows the position of the tip 244 of the deflector when lever 28 has been moved to the end of slot 30 closest to button 24. When the lever is moved to the end of slot 30 closest tee-like device 18, the tip 244 projects through a slot 246 in tube 44 as shown in FIG. 11*b*. As also seen in this figure, aperture 20 in the mat 5 has a diameter less than the interior diameter of tube 44. A smooth transition between the interior of the tube and the aperture is formed by a neck 248.

OPERATION

The apparatus 1 is manually operated by pushing button 24, normally with the foot. The only control other than the button is lever 28.

Before using the apparatus, door 16 is opened and a pluality of golf balls are dropped into the ball storage compartment until all of the storage racks 98 and the area on top of sloped surface 94 are filled with golf balls. Approximately 100 golf balls can be stored. After the apparatus is filled, the door is closed. The golfer then presses button 24 with his foot. This simultaneously lowers lever 150 and the first end 198 of second lever 194. The second end 200 of the second lever is simultaneously raised together with the first end 202 of the third lever 196. The second end 204 of the third lever is therefore lowered to the position shown in broken lines in FIGS. 7 and 8. Since this end of the lever is between the top rails and bottom rail of the ball elevator, the ball elevator moves to the horizontal lower position also illustrated in broken lines. Four balls from the discharge end 104 of the ball storage compartment roll onto the guide track formed by the top rails 108 and 110 of the ball elevator. The golfer then releases button 24 and resiliently biased damping device 162 simultaneously raises lever 150 and the second end 204 of the third lever 196. Ball elevator 106 is thereby moved to the raised position shown in solid lines in FIGS. 7 and 8 by the action of the third lever and springs 120 and 122. The stops formed by portions 144 and 146 of spring housings 116 and 118 hold the raised ball elevator in the tilted position shown in FIG. 7 sloped downwardly towards feed guide track 80. The balls on the top rails 108 and 110 therefore roll down the top rails which at this point act as a guide track for the balls. When the balls reach the feed guide track, the first ball makes a right angled turn and rolls to the position of ball 22.1 in FIG. 3*b*, while the next ball fills in the space behind it.

At this point, the golfer again pushes button 24. This lowers lever 150 which thereby moves tee-like device 18 to the lower position of FIG. 3*d*. When the prongs 154 and 156 are near the bottom of the apparatus, they contact rollers 170 and 172, lowering first ends 178 and 180 of feed levers 182 and 184 and thereby raise the second ends 186 and 188 of the feed levers which raise the ball raising device 54. The back wall 56 of the ball raising device prevents the next ball in line from moving as illustrated in FIG. 3*d*. At the same time, the ball raising device is raised to the position shown where the ball on top is aligned with aperture 50 in the tube 44. The ball rolls down the sloped top of the ball raising device and enters the tube, resting on the top 38 of the tee-like device. While this is occurring, the ball elevator is again at the lower position shown in FIGS. 7 and 8 where more balls can roll off of the storage rack to fill the spaces available on the ball elevator. The golfer then releases button 24. This permits lever 150 to raise, thus moving the tee-like device 18 to the raised position of FIG. 3*b*, while returning the ball raising device 54 to the lower position of FIG. 3*b* and raising the ball elevator to the raised position. Thereafter, each push of the button 24 loads a ball onto the tee-like device and releasing the button moves another ball to above the upper surface 4. This may be continued until the ball storage compartment and guide track means are empty.

The operation of the device as described above is with lever 28 at the end of slot 30 closest to button 24 as illustrated in FIGS. 3*b* and 3*d*. Since control rod 224 is connected to the lever, it is in the retracted position of FIG. 11*a* where tip 244 of the deflector does not extend through slot 246 in the tube. The tee-like device therefore remains straight as it projects through the top of the tube and aperture 20 in the upper surface of the apparatus. The ball remains on the top 38 of the tee-like device. However, the golfer may wish to hit the balls from the carpet 3 instead of from the top of the teeing device. This is achieved by pushing lever 28 to the opposite end of slot 30 which is closest to tee-like device 18. This moves control rod 224 towards the tube so tip 244 of the deflector projects through aperture 246 into the tube just below aperture 20 in the upper surface. In this position, the base 32 of the tee-like device contacts the tip 244 as the tee-like device reciprocates upwardly after button 24 is released. As mentioned previously, tube 44 has a larger internal diameter than the diameter of the tee-like device, so the tee-like device is tilted near the top of the tube as illustrated in FIG. 11*b*. In addition, slots 46 and 48 are wider than tabs 40 and 42 and have cut out portions 250 to permit the tilting. Therefore, the ball rolls off of the top 38 onto the carpet after the top 38 is above the surface. Spring 242 permits lever 28 to be moved even if the tee-like device is in the raised position, but the tilted position cannot be achieved until button 24 is pushed and released again. In the preferred embodiment of FIGS. 11*a* and 11*b*, the aperture 20 in the mat 5 is smaller in diameter than the interior of the tube to assure that the tee-like device remains straight as it emerges above the upper surface 4 when tip 244 is retracted.

I claim:

1. A golf ball teeing apparatus having an upper surface and comprising:

a tee means having a ball receiving top and being vertically reciprocable between a retracted position and a raised position where the top is above the upper surface;

feed means for feeding one ball at a time onto the top of the tee means, the feed means being generally adjacent the top of the tee means when the tee means is in the retracted position;

a guide track means sloping downwardly towards the feed means;

a ball storage rack means below the upper surface and sloping downwardly towards a discharge end thereof;

ball elevating means for raising balls from a lower position adjacent the discharge end of the storage rack means to an upper position where the balls can roll down the guide track means to the feed means.

2. A golf ball teeing apparatus comprising:

a casing having an upper surface with an aperture;

a tee means for holding a ball, the tee means having a ball receiving top and being vertically reciprocable between a retracted position where the tee means is within the casing and a raised position where the tee means extends through the aperture and the top is above the upper surface;

feed means within the casing for feeding one ball at a time onto the top of the tee means, the feed means being generally adjacent the top of the tee means when the tee means is in the retracted position;

a guide track means within the casing for guiding balls towards the feed means, the guide track means having a receiving end and sloping downwardly from the receiving end to the feed means;

a ball storage rack means within the casing below the upper surface for storing a plurality of balls and sloping downwardly towards a discharge end thereof;

ball elevating means within the casing for raising balls from a lower position where the ball elevating means is adjacent the discharge end of the storage rack means to an upper position where the ball elevating means is adjacent the receiving end of the guide track means so the ball can roll down the guide track means to the feed means.

3. An apparatus as claimed in claim 2, wherein the ball elevating means and the feed means are operatively connected to the tee means for movement therewith.

4. An apparatus as claimed in claim 3, wherein the storage rack means comprises a plurality of parallel storage racks having adjacent discharge ends.

5. An apparatus as claimed in claim 4, wherein the ball elevating means comprises a vertically movable portion of said guide track means, the elevating means being generally horizontal in the lower position.

6. An apparatus as claimed in claim 5, wherein each of the storage racks and the guide track means comprises a pair of spaced apart rails.

7. An apparatus as claimed in claim 5, further comprising resilient means connected to the ball elevating means for biasing the ball elevating means towards the upper position, and stop means for stopping the ball elevating means in the upper position.

8. An apparatus as claimed in claim 1, further comprising a lever mechanism connected to the ball elevating means, the feed means and the tee means for coordinated movement thereof.

9. An apparatus as claimed in claim 8, wherein the lever mechanism comprises a first upwardly biased lever having a button means for manual movement of the lever extending above the upper surface of the apparatus, the tee means being operatively connected to the lever so the tee means is moved to the retracted position when the button means is pushed.

10. An apparatus as claimed in claim 9, wherein the ball elevating means is operatively connected to the first lever so the ball elevating means is in the lower position when the button means is pushed and is moved to the upper position when the button means is released.

11. An apparatus as claimed in claim 10, wherein the ball elevating means is connected to the first lever by second and third levers, each of the second and third levers being pivotable between a first end and a second end thereof, the second lever being connected to the first lever near the first end of the second lever by a hinged and slotted connection, the second lever being connected to the third lever near the second end of the second lever and the first end of the third lever by a hinged and slotted connection, the second end of the third lever engaging the ball elevating means.

12. An apparatus as claimed in claim 1, wherein the feed means comprises a vertically reciprocable ball raising device having a lower ball receiving position aligned with the guide track means, the ball raising device being capable of receiving one ball from the guide track means, and a raised feeding position where the one ball is raised above the guide track means.

13. An apparatus as claimed in claim 12, wherein the ball raising device has a ball receiving top which is sloped downwardly towards the top of the tee means in the raised position.

14. An apparatus as claimed in claim 13, wherein the feed means further comprises a first stop means for stopping a ball on the sloped top of the ball raising device in the lower position and a second stop means for stopping a ball on the guide track means adjacent the ball raising device when the ball raising device is in the raised position.

15. An apparatus as claimed in claim 14, wherein the apparatus further comprises a vertical tube, the tee means being vertically reciprocable within the tube, the tube comprising the first stop means and having an aperture therein aligned with the raised position of the ball raising device, the apparatus being sized for passage of a ball from the ball raising device to the tee means.

16. An apparatus as claimed in claim 14, wherein the second stop means comprises a wall of the ball raising device extending downwardly from the top thereof.

17. An apparatus as claimed in claim 12, wherein the apparatus further comprises a lever mechanism for reciprocating the tee means and the feed means.

18. An apparatus as claimed in claim 17, wherein the lever mechanism comprises an upwardly biased first lever, the apparatus having button means extending through the upper surface for depressing the first lever and thereby raising the ball raising device and lowering the tee means.

19. An apparatus as claimed in claim 18, wherein the ball raising device and the tee means operatively engage the first lever near a first end thereof.

20. An apparatus as claimed in claim 19, further comprising a feed lever having first and second ends and being pivotal between the ends thereof, the first end of the feed lever engaging the first end of the first lever and the second end of the feed lever engaging the ball raising device.

21. An apparatus as claimed in claim 19, further comprising resilient means for downwardly biasing the ball feeding device.

22. An apparatus as claimed in claim 1, further comprising a vertical tube, the tee means being vertically reciprocable in the tube, the tee means having a cross sectional extent slightly less than the cross sectional extent of the tube; and deflection means selectively projectable into the tube to tilt the tee means as the tee means moves to the raised position so a ball moving upwardly on the tee means is discharged onto the upper surface of the apparatus.

* * * * *